United States Patent [19]

Sage

[11] 4,139,028

[45] Feb. 13, 1979

[54] DEVICE FOR THE SELECTIVE ACTUATION OF THE NEEDLE SELECTION MEMBERS IN NEEDLES LOOMS

[75] Inventor: Paul Sage, Lyons, France

[73] Assignee: Verdol S.A., Caluire, France

[21] Appl. No.: 862,900

[22] Filed: Dec. 21, 1977

[51] Int. Cl.[2] ..... D03C 3/16

[52] U.S. Cl. ..... 139/331; 139/59

[58] Field of Search ..... 139/331, 329, 59, 68, 139/317

[56] References Cited

U.S. PATENT DOCUMENTS

| | | | |
|---|---|---|---|
| 2,305,328 | 12/1942 | Turner | 139/68 |
| 2,305,330 | 12/1942 | Turner | 139/68 |
| 3,069,608 | 12/1962 | Forrester et al. | 318/162 |

FOREIGN PATENT DOCUMENTS

| | | | |
|---|---|---|---|
| 2297265 | 1/1975 | France | 139/68 |
| 1008665 | 11/1965 | United Kingdom | 139/331 |
| 1082729 | 12/1967 | United Kingdom | 139/329 |
| 1304683 | 1/1973 | United Kingdom | 139/317 |

*Primary Examiner*—James Kee Chi

*Attorney, Agent, or Firm*—Dowell & Dowell

[57] ABSTRACT

A device for the selective actuation of the needle selection members in needles looms using a perforated paper pattern, of the kind comprising memory means for recording information which corresponds to the perforations of the paper, them for controlling, as a function of this information, the members it is desired to displace is characterized in that it comprises a memory having displaceable members lockable in position, means for applying this memory to the perforated paper in order to displace selectively the said elements as a function of the perforations and means for applying it then to the selection members in such manner that the elements displace the latter in accordance with the information they have registered.

9 Claims, 15 Drawing Figures

DEVICE FOR THE SELECTIVE ACTUATION OF THE NEEDLE SELECTION MEMBERS IN NEEDLES LOOMS

The present invention concerns a method permitting the selective actuation of the hooks of a needle loom of the Jacquard or Verdol type by means of a perforated card. The invention also concerns a device for carrying out the said method.

In needle looms of the Jacquard or Verdol type, the sinkers for controlling the hooks so that they avoid the reeds of the heald frames are actuated by means of perforated card or paper which unwind in stepwise fashion. It will be readily perceived that the co-operation of the sinkers with each section of the paper lasts a considerable time, thus interfering with the tempo of the mechanism, moreover, contact of the sinkers with the card tends to cause serious wear on the card.

An object of the present invention is to permit an increase in the speed of operation of looms of the Jacquard or Verdol kind, whilst avoiding premature wear on the card or paper, thus involving a substantial economy in terms of work time and replacement of cards. The invention accordingly provides a device for the selective actuation of the needle selection members in needle looms using a perforated paper pattern, of the kind comprising memory means for recording information which corresponds to the perforations of the paper, then for controlling, as a function of this information, the members it is desired to displace, characterised in that it comprises a memory having displaceable members lockable in position, means for applying this memory to the perforated paper in order to displace selectively the said elements as a function of the perforations and means for applying it then to the selection members in such manner that the elements displace the latter in accordance with the information they have registered.

The accompanying drawings, given by way of example, will make it easier to understand the invention, the features thereof and the advantages it is capable of procuring. In the drawings.

Figure 3:
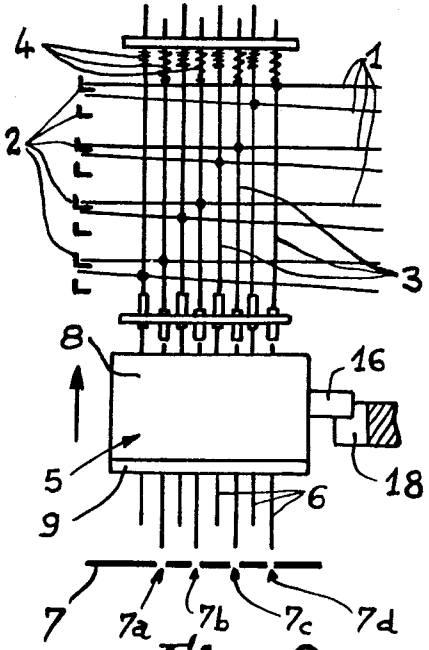
FIGS. 1 to 3 are schematic views which illustrate the operation of a device for carrying out the process according to the present invention.
Figure 2:
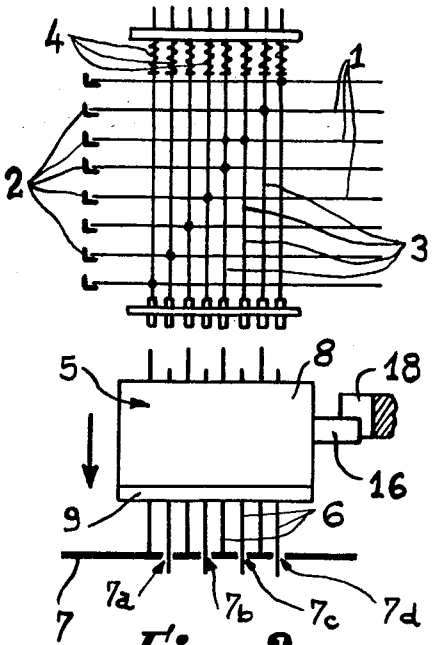
Figure 1:
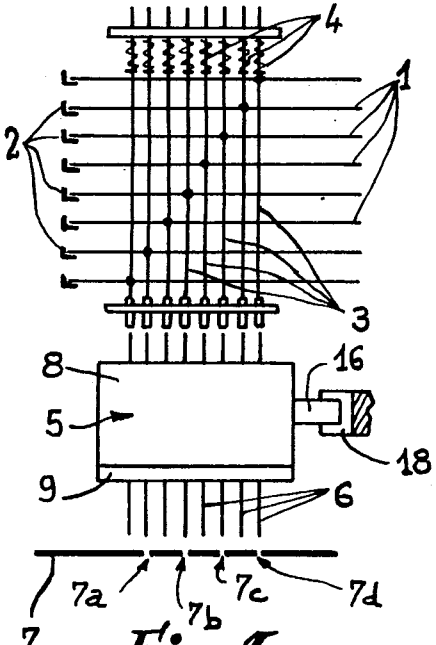

Shown schematically in FIGS. 1 to 3, is part of a needle loom of the Verdol type, in which the needles 1 driving the hooks (not shown) are actuated by a series of bars 2. It will be briefly recalled that each of the needles 1 is associated with a sinker 3 which can be raised against the reaction of a spring 4 so that the needle is raised to avoid the action of the train of bars (FIG. 3).

In view of the actuation of the sinkers 3, it has been proposed, according to the invention, to provide a selection case 5 which is traversed by the vertical rods 6, the number of which is identical to that of the sinkers 3 and which are disposed directly opposite said sinkers. The rods 6 extend out above and below the case 5. By means of a mechanism that will be described hereinafter, the case 5 is lowered in the direction of card or paper comprising in known manner perforations *7a, 7b, 7c, 7d* and so on. It will be readily understood that, when the rods 6 come into contact with the card, some of them opposite the aforementioned perforations *7a – 7d,* are not actuated by the paper, whereas the others which abut the paper are axially displaced upwardly. As will be explained hereinafter, the case 5 is then raised so that the rods which have been actuated by the paper bear against the corresponding sinkers 3 in order to raise them (FIG. 3), then the rods return to the initial position shown in FIG. 1 and so on with each stopping of the paper.

Figure 4:
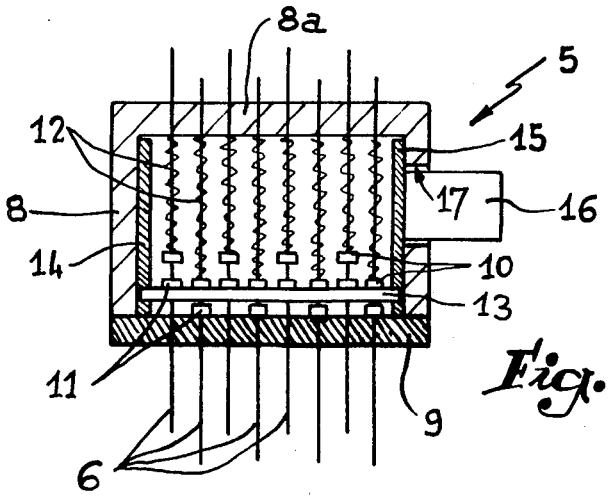
FIG. 4 is a vertical section through the control box or memory of a device designed in accordance with the present invention.
Figure 6:
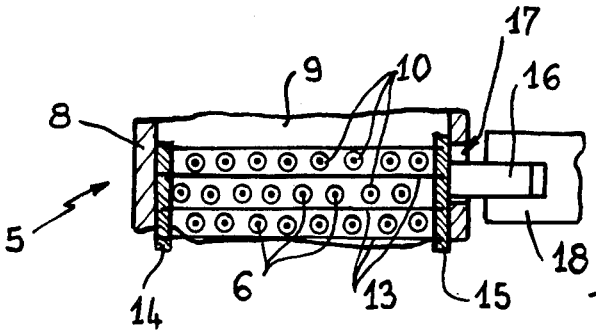
FIGS. 6 and 7 are top views in partial section of the case shown in FIG. 4.
Figure 5:
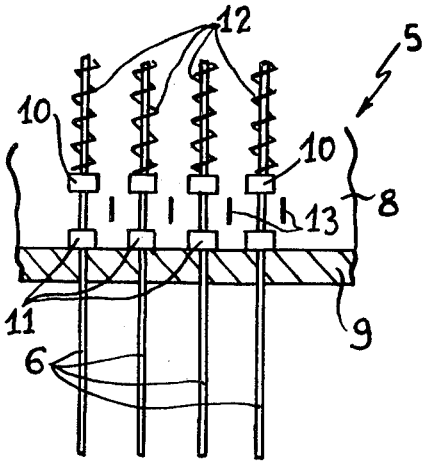
FIG. 5 is a view of a detail thereof on a magnified scale.
Figure 8:
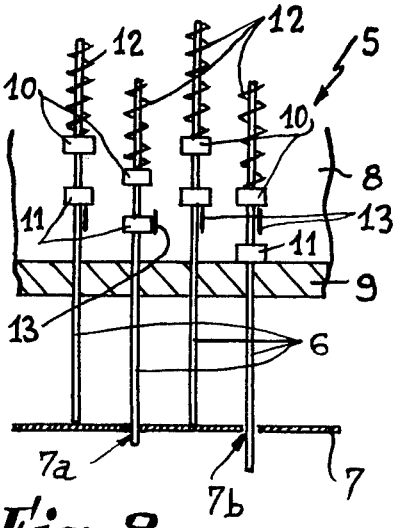
FIG. 8 is a view similar to that of FIG. 5 showing the rods locked.

The above-mentioned case 5 is shown schematically in FIG. 4. It comprises a hollow body 8, presented roughly in the form of a turned down U-shaped drain, the opening of which is closed by a base 9. The said base 9 and the bottom 8*a* of the body 8 are perforated correspondingly in order to let the rods 6 pass through. Each of the rods comprises two abutments 10, 11 the first of which co-operates with one of the ends of a compression spring 12, the opposite end of which bears against the inner face of the bottom 8*a* so that the abutment 11 which is disposed below 10 rests against the base 9 in the neutral position of the case 8 (FIGS. 1 and 5). Placed between each row of rods 6 is an elastic blade 13, the ends of which are fitted in the bars 14, 15 connected together by means (not shown). The bar 15 is connected to a lug 16 which passes through one of the lateral partitions of the body 8 in an elongated opening 17 in order to co-operate with a fork 18, as will be explained in greater detail hereinafter. The fork 18 is horizontally displaced so that each of the blades 13 co-operates with the corresponding row of rods 6 (FIG. 8). The locking is sufficiently strong for the rods 6 to remain axially secured at the moment they act on the corresponding sinkers 3 in order to displace them upwardly, as shown in FIG. 3, since the abutments 11 then bear on the upper edge of each blade (FIG. 8).

Figure 7:
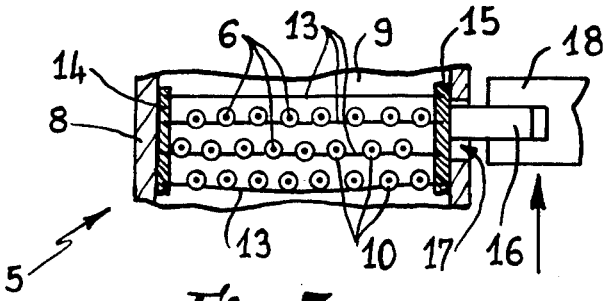

It has been decided to make the blades 3 of spring steel so that one of the rods fails to complete its entire rising movement at the time of locking for one reason or the other, the corresponding blade 13 bears against the periphery of its abutment 11, whilst still forming the support provided for the abutments 11 of the other rods 6 of the same row (FIGS. 7 and 8).

Figure 9:
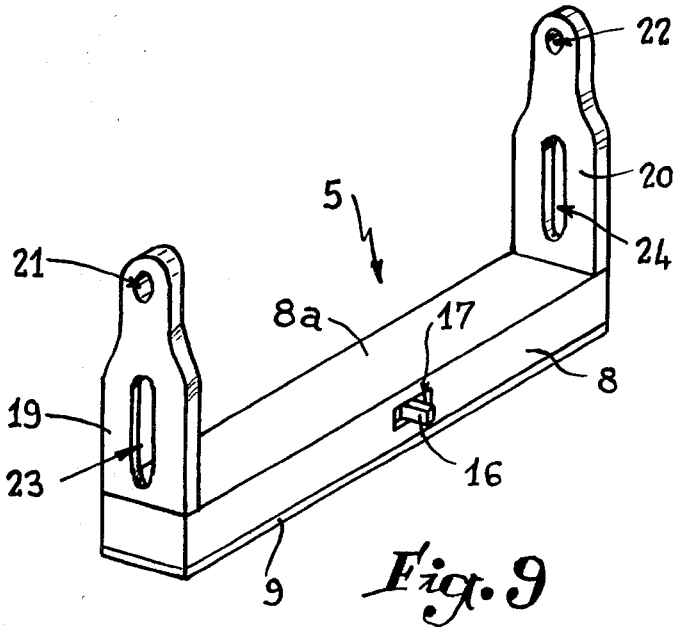
FIG. 9 is a view in perspective, on a small scale, of the selection case of a device according to the invention.

As shown in FIG. 9, the case 5 is provided at each of its ends with a vertical plate 19, 20 which is intended for its actuation and comprises a thinner end portion provided with respective holes 21, 22 whilst an elongated vertical opening 23, 24 is formed in its centre.

Figure 10:
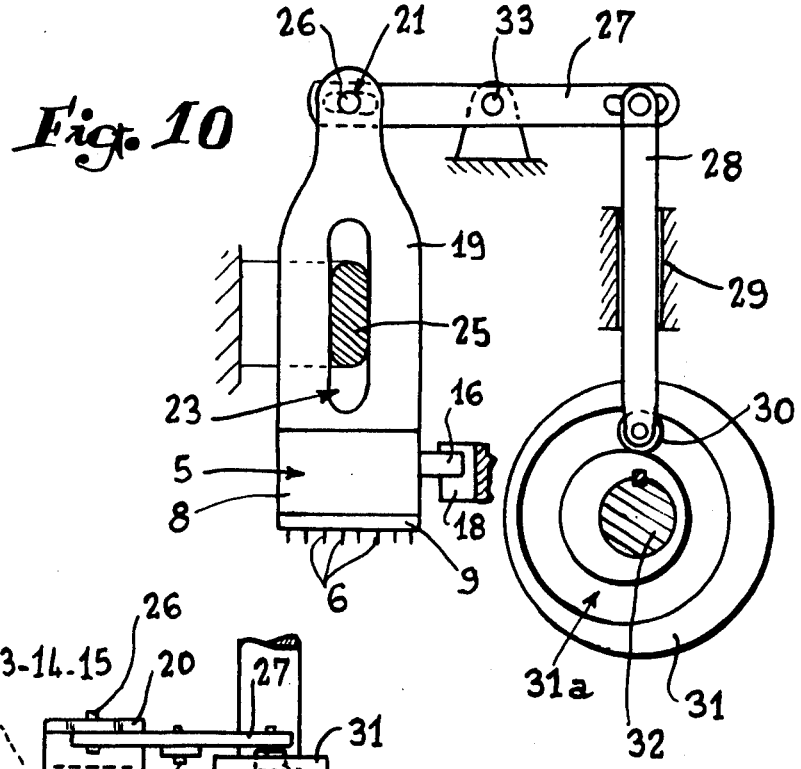
FIG. 10 shows the vertical actuating mechanism of the case.

Shown schematically in FIG. 10 is the assembly of the device constructed in accordance with the invention. It will be observed that a fixed guide 25 is engaged in the opening in each plate so that it can be displaced only vertically by a pre-determined amplitude. Engaged in each hole 21, 22 is a spindle 26 to which there is linked one of the ends of a connecting rod 27, the other end of which co-operates with the corresponding end of a lever 28 intended to be vertically displaced in slides 29. The lower part of the lever 28 is provided with a roller 30 which is disposed in the groove 31*a* of a desmodromic cam 31 keyed on a horizontal shaft 32. Since the centre part of the connecting rod is mounted to pivot about a spindle 33 when the shaft turns, it produces a vertical reciprocating movement of the plates 19 and 20 and, consequently of the case 5. The groove 31*a* is formed so that the cooperation of the rods 6 and the card is effected within a pre-determined time, that is to say, according to a certain annular amplitude of the shaft 32.

In order to control the displacement of the fork 18, said fork is associated with a sleeve 34 mounted to slide on the shaft 32 by means of needle bearings 35. In order to avoid the rotation of the sleeve 34, said sleeve comprises a radial finger 36 which engages in a retaining cap 37. The sleeve is also connected to an arm 38 directed in parallel to the geometrical axis of the shaft 32 and carrying a roller 39 co-operating with the groove 40*a* of a cam 40 keyed on the shaft 32 between the cams 31. The shape of the groove 40*a* is such that it communicates to the sleeve 34 an axial reciprocating movement which controls that of the lug 16 of the case 8 in order to lock the rods 6 synchronously with the vertical displacement of the case 5. Due to the presence of the fork 18, the lug 16 can be vertically displaced therein.

The device according to the present invention which has just been described is intended for carrying out a method to be applied to a needle loom, the card of which is displaced in a jerky manner.

Figure 12:
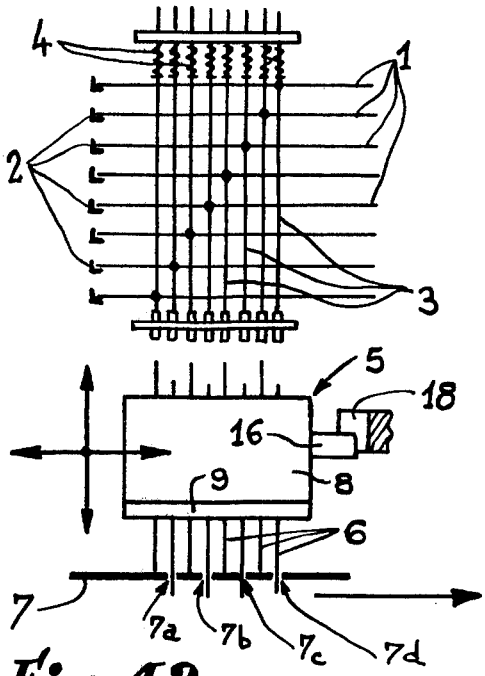
FIG. 12 is a view similar to that of FIG. 2 but the case thereof is subjected to a movement causing it to co-operate with the card or paper when the latter is unwinding continuously.
Figure 13:
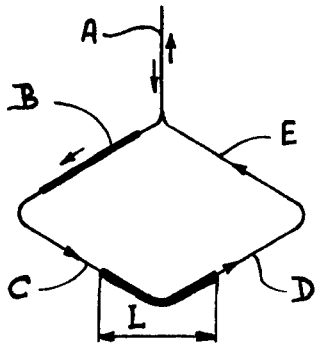
FIG. 13 is a schematic view of the path of the selection case.
Figure 14:
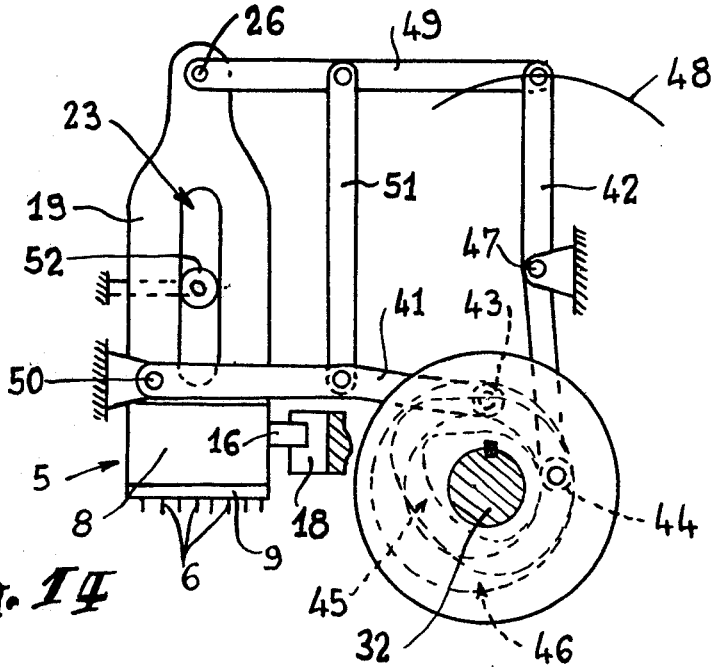
FIG. 14 shows the mechanism permitting the displacement of the case according to the diagram shown in FIG. 13.

It is quite easy to envisage the application of the aforementioned method to a mechanism, the card of which unwinds continuously. In order to do this, it is then necessary for the selection box containing the rods, that is to say, the mechanical memory, to be displaced at the same speed as the card over a certain distance. In other words, and as shown in FIGS. 12 and 13, the case 5 should have a vertical reciprocating movement combined with a similar horizontally oriented movement. Starting from the contact position of the rods 6 with the needles 3, the case should first of all descend vertically in the direction of the card according to a displacement A, then be obliquely displaced in the direction of the card and in the reverse direction of the unwinding thereof (path B) then obliquely in the reverse direction according to a path C, the case then rises following the paths D, E respectively symmetrical with C and B, in order then to finish its upward movement according to the displacement A. The selection, that is to say, the co-operation of the rods 6 of the casing with the card, is effected over a distance L extending symmetrically on both sides of the low point of the paths C and D.

The mechanical system for effecting the movement shown schematically by the curve in FIG. 13, comprises two pairs of levers 41, 42 located on each side of the case 5. One of the ends of each of the levers is provided with a roller 43, 44, for co-operating with a cam 45, 46. The lever 42 is mounted to swing about a pivot 47 so that its opposite end describes a portion of a circumference 48. This end is connected to that of a connecting rod 49 associated with the spindle 26 of the corresponding plate of the case. The end of the second lever 41 opposed to that carrying the roller 43 is mounted to pivot relative to a fixed pivot 50. A bar 51 is linked to the centre portion of the connecting rod 49 and the lever 41. In order to permit the displacement of the case 5, each of the openings 24 of each plate co-operates with a fixed roller 52 ensuring the guiding thereof when the assembly of the case is subjected to the movements of the end of the connecting rod 49.

Figure 11:
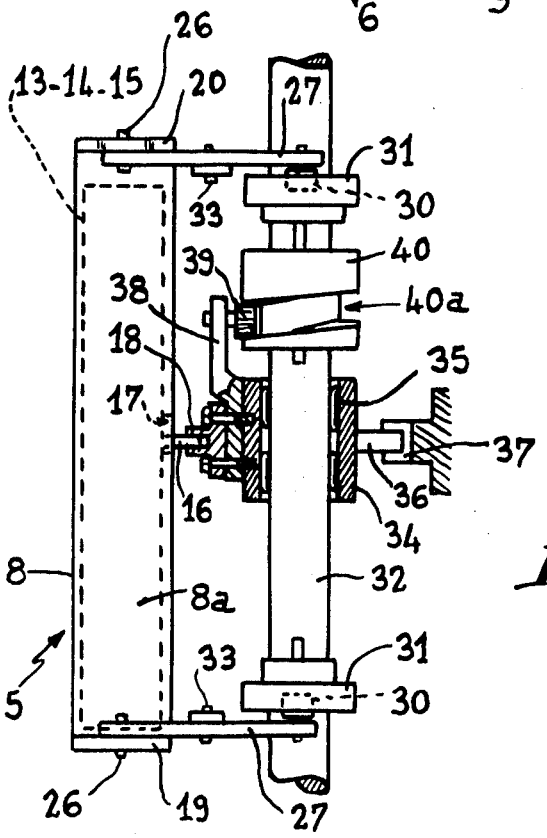
FIG. 11 is a top view thereof, on a smaller scale, with broken away portions, showing more particularly the control of the locking of the rods.
Figure 15:
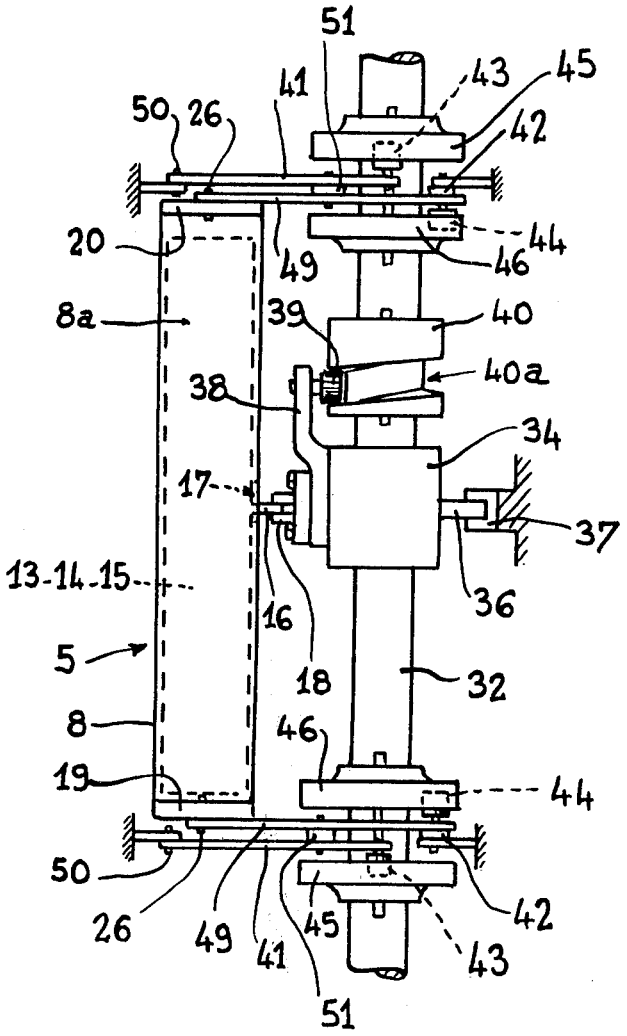
FIG. 15 is a view similar to that of FIG. 11, but showing a top view, on a smaller scale, of the system shown in FIG. 14.

As shown in FIG. 15, the shaft 32 is provided with the device 34, 35, 36 of FIG. 11 for controlling the lateral displacement of the lug 16 on the case 5 for locking the rod 6 immediately after cooperation thereof with the card. It will be noted that the groove 40*a* of the cam 40 is provided for unlocking the rods on the path B (FIG. 13) of the case, that is to say after the rods have abandoned with the sinkers 3.

Naturally, the continuous unwinding of the card need not be a movement of constant speed so that, at the moment of contact of the rods with the card, said card is displaced only with reduced speed.

Due to the process according to the present invention and the devices for carrying it into practise, a considerable increase in yield has therefore been obtained, since, formerly, by way of example, the immobolisation of the card was effected in an angle of 270° of the main shaft, the advance of the card being effected at an angle of 90°, whereas it is now possible to reverse these details, the immobilisation being effected during a rotation of 90° of the main shaft, whilst the advance of the card is effected during the remainder of its rotation.

It should, however, be understood that the foregoing description is given only by way of example and in no way limits the scope of the invention which would also include any other details of construction in addition to those already described.

What I claim is:

1. A device for the selective actuation of the needle selection members in a needles loom using a perforated paper pattern which is advanced at a speed controlled by the operating cycle of the loom, the loom having memory means for recording information which corresponds to the perforations of the paper pattern by positioning rod members of the memory means selectively in either their neutral positions or in displaced positions as a function of this information, characterized in that the device further comprises means for applying the memory means to the advancing paper pattern during a first portion of the cycle of the loom to move the rod members to said positions; means responsive to a second portion of the cycle of the loom to lock the rod members in said selected positions; means responsive to a third portion of the cycle of the loom to remove the memory means from the paper pattern and apply the rod member to said needle selection members to actuate said needles selection members in response to the locked positions of the rod members, means responsive to a fourth portion of the cycle of the loom to unlock the rod members; and means operative in response to the cycle of the loom to reciprocate the memory means so that it advances with the advance of the paper pattern and at the same speed during the first and second portions of said cycle and retracts during other portions of said cycle.

2. The device as claimed in claim 1, wherein the device further comprises a shaft rotating synchronously with said cycle of the loom and with the advance of the paper pattern and coupled to drive said means responsive to said portions of the cycle, and the device further including means driven by said shaft and operative to reciprocate the memory means in a second direction normal to the direction of advance of the paper pattern to remove the memory means from the pattern and apply the rod members to the needle selection members.

3. The device as claimed in claim 2, wherein said means operative to reciprocate the memory means comprises cam means attached to rotate with the shaft; fixed guide means cooperating with the memory means and allowing it to rock so that one portion of the memory means can reciprocate in a first direction corresponding with the advance of the paper pattern and the guide means allowing it to reciprocate in said second direction; a first lever actuated by the cam means to move in said first direction; a second lever actuated by the cam means to move in said second direction; and means coupling the levers to the memory means to reciprocate it in said first and second directions.

4. The device as claimed in claim 2, wherein said memory means comprises a case having said rod members extending therefrom and spring urged toward said neutral positions, and said locking means comprising a cam on said shaft; a cam follower; flexible blades in the case adjacent to the rod members; and means coupling the cam follower to actuate the blades to bear against the rod members during said second portion of the cycle.

5. The device as claimed in claim 4, wherein said cam and said cam means are fixed to said shaft and angularly oriented to sequentially actuate said means responsive to said first, second, third and fourth portions of said cycle.

6. The device as claimed in claim 4, wherein said cam follower comprises a sleeve surrounding said cam and slidable axially of the shaft while engaging the cam, the sleeve being fixed against rotation with the shaft and having a member extending from the sleeve and engaging said coupling means to actuate said blades.

7. The device as claimed in claim 2, wherein the device is operated in cooperation with Verdol-type paper pattern means which advances the paper pattern intermittently, and wherein said means operative to reciprocate the memory means are driven by said shaft such that said first portion of the cycle of the loom spans the stopping and the starting of the advance of the paper pattern, whereby the memory means is applied to the pattern before the advance of the pattern is stopped and continues after the advance of the pattern commences so that the stopping time of the pattern can be reduced.

8. The device as claimed in claim 9, wherein said means operative to reciprocate the memory means comprises cam means attached to rotate with the shaft, said memory means having a case supporting said rod members; guide means limiting the case to tilting motion about an axis transverse to the direction of advance of the paper pattern and to reciprocating motion toward and away from the paper pattern; a first lever actuated by the cam means to tilt the case; a second lever actuated by the cam means to reciprocate the case toward and away from the paper pattern; and means coupling the levers to the case.

9. The device as claimed in claim 2, wherein said means responsive to portions of said cycle and said means operative to reciprocate the memory means in a second direction comprise a system of articulated interconnected levers driven by the shaft and coupled to the memory means and operative in a repeating cycle to move the memory means from the needle selection members toward the paper pattern, then to move the memory means in a direction counter to the advance of the pattern, then to move the memory means in the direction of advance of the pattern and into engagement therewith, then to move the memory means out of engagement with the pattern, and finally toward and into engagement with the needle selection members.

* * * * *